US011595756B2

(12) United States Patent
Yazawa et al.

(10) Patent No.: US 11,595,756 B2
(45) Date of Patent: Feb. 28, 2023

(54) SOUND COLLECTING APPARATUS

(71) Applicant: NIPPON TELEGRAPH AND TELEPHONE CORPORATION, Tokyo (JP)

(72) Inventors: Sakurako Yazawa, Tokyo (JP); Kazunori Kobayashi, Tokyo (JP)

(73) Assignee: NIPPON TELEGRAPH AND TELEPHONE CORPORATION, Tokyo (JP)

( * ) Notice: Subject to any disclaimer, the term of this patent is extended or adjusted under 35 U.S.C. 154(b) by 0 days.

(21) Appl. No.: 17/285,794

(22) PCT Filed: Nov. 19, 2019

(86) PCT No.: PCT/JP2019/045266

§ 371 (c)(1),
(2) Date: Apr. 15, 2021

(87) PCT Pub. No.: WO2020/105632

PCT Pub. Date: May 28, 2020

(65) Prior Publication Data

US 2021/0352402 A1 Nov. 11, 2021

(30) Foreign Application Priority Data

Nov. 22, 2018 (JP) ..... JP2018-219222

(51) Int. Cl.
*H04R 1/40* (2006.01)

(52) U.S. Cl.
CPC ..... *H04R 1/406* (2013.01)

(58) Field of Classification Search
CPC .. H04R 1/406; H04R 2201/401; H04R 3/005; H04R 5/027
USPC ..... 381/92, 307, 310, 26, 336, 91
See application file for complete search history.

(56) References Cited

U.S. PATENT DOCUMENTS

| | | | | |
|---|---|---|---|---|
| 4,332,979 | A | 6/1982 | Fischer | |
| 2015/0117672 | A1 | 4/2015 | Christoph | |
| 2017/0311080 | A1 | 10/2017 | Kolb et al. | |
| 2018/0047407 | A1* | 2/2018 | Mitsufuji | H04R 3/005 |

FOREIGN PATENT DOCUMENTS

| | | | |
|---|---|---|---|
| CN | 103389155 | A | 11/2013 |
| JP | 2014-165901 | A | 9/2014 |
| JP | 2016-082414 | A | 5/2016 |
| JP | 2017-143406 | A | 8/2017 |

* cited by examiner

*Primary Examiner* — Thjuan K Addy

(57) ABSTRACT

A sound collecting apparatus includes a base of a substantially spherical body and a plurality of microphones provided on the base, a number of the microphones having a predetermined constraint, the plurality of microphones being alternately arranged vertically relative to a horizontal plane including a center of the substantially spherical body in order to improve resolution in a horizontal direction.

22 Claims, 19 Drawing Sheets

(a)

(b)

SOUND COLLECTING APPARATUS

CROSS-REFERENCE TO RELATED APPLICATIONS

This application is a U.S. 371 Application of International Patent Application No. PCT/JP2019/045266, filed on 19 Nov. 2019, which application claims priority to and the benefit of JP Application No. 2018-219222, filed on 22 Nov. 2018, the disclosures of which are hereby incorporated herein by reference in their entireties.

TECHNICAL FIELD

The present invention relates to a sound collection technique, and more particularly to a technique for collecting sounds arriving in a plurality of directions.

BACKGROUND ART

An example of a technique for collecting sounds arriving in a plurality of directions includes a technique disclosed in Patent Literature 1. Patent Literature 1 discloses a technique for estimating and extracting information (a signal or a position of a target sound source) on any target sound source by linear filtering using an acoustic array device (a sound collecting apparatus) including a plurality of microphones.

CITATION LIST

Patent Literature

Patent Literature 1: Japanese Laid-Open Patent Publication No. 2016-82414

SUMMARY OF THE INVENTION

Technical Problem

A large number of microphones are required to accurately collect sounds in all directions with the sound collecting apparatus disclosed in Patent Literature 1. For example, it is conceivable to install microphones at all vertices of a regular dodecahedron inscribed in a sphere, but in this case, the number of microphones to be required is 20, which is costly and not preferable.

Further, there is also a demand for collecting only a sound arriving in a predetermined direction rather than sounds in all directions with high resolution. For example, in a case of a voice uttered by a person, there are also demands for keeping high resolution of the sound arriving in a horizontal direction from an average height of the person based on the ground, and for not reducing resolution of the sound arriving from a position higher by a predetermined width than the average height and the sound arriving from a position lower by a predetermined width than the average height in consideration of variations of height of persons.

An object of the present invention, which has been made in view of the above circumstances, is to provide a sound collecting apparatus capable of collecting sounds arriving in all directions and collecting sounds in a horizontal direction with higher resolution.

Means for Solving the Problem

According to the disclosed technique, a sound collecting apparatus is provided, which includes: a base of a substantially spherical body; and a plurality of microphones provided on the base, a number of the microphones having a predetermined constraint, the plurality of microphones being alternately arranged vertically relative to a horizontal plane including a center of the substantially spherical body in order to improve resolution in a horizontal direction.

Effects of the Invention

According to the disclosed technique, it is possible to provide a sound collecting apparatus to provide a sound collecting apparatus capable of collecting sounds arriving in all directions and collecting sounds in a horizontal direction with higher resolution.

DESCRIPTION OF EMBODIMENTS

Embodiments of the present invention will be described below with reference to the drawings. The embodiments described below are merely examples, and the present invention is not limited to the embodiments. First and second embodiments will be described below. Regarding the second embodiment, differences from the first embodiment will be mainly described.

First Embodiment

Figure 1:
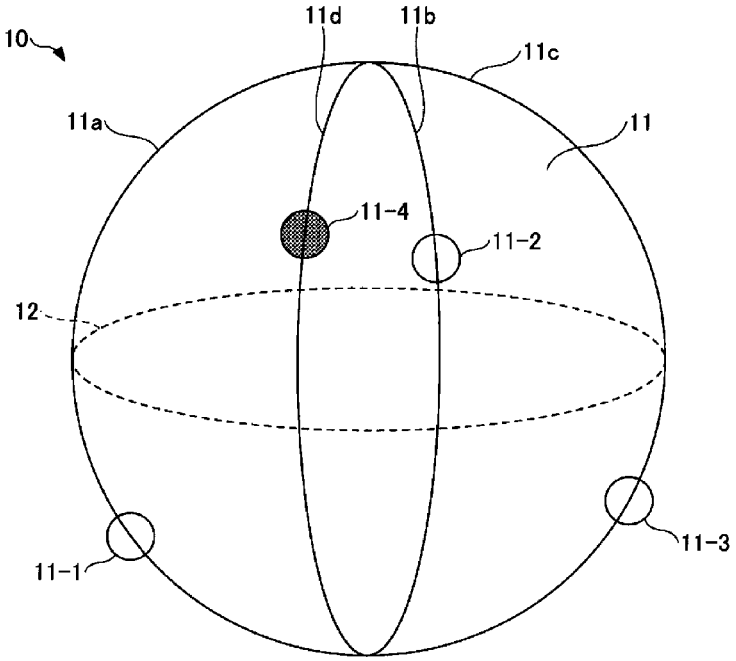
FIG. 1 is a view for illustrating a basic configuration of a sound collecting apparatus 10.

FIG. 1 shows a basic configuration example of a sound collecting apparatus 10 according to the first embodiment.

As shown in FIG. 1, the sound collecting apparatus 10 has a configuration in which a plurality of microphones (11-1 to 11-4) are provided on a surface of a spherical base 11. In addition, each of the drawings showing the sound collecting apparatus in the first and second embodiments does not accurately present the arrangement and sizes of components of the sound collecting apparatus. Although the sound collecting apparatus 10 shown in FIG. 1 includes four microphones, this is an example. The number of microphones is not particularly limited as long as being two or more. However, it is assumed that the number of microphones has a predetermined constraint and is smaller than 20, which is the number of all vertices of a regular dodecahedron. However, the number 20 is merely an example.

The spherical body is regarded as earth for convenience and terms such as the equator, the north pole, the south pole, the latitude, and the longitude are appropriately used to easily explain matters related to the spherical body forming the base 11. The "equator" used herein is a line (circle) around a disk formed when the sphere is cut along a horizontal plane including a center of the spherical body. The north pole and the south pole are two points where a straight line passing through the center of the spherical body intersects the surface of the spherical body, when viewed by a person, a higher point is called the north pole, and a lower point is called the south pole. Note that the "horizontal" in the description and claims does not have to be strictly horizontal, and may include a direction inclined within a predetermined threshold range from a strictly horizontal state (a direction of a plane vertical to a gravity direction). In addition, the "horizontal" may be defined as a level that a person perceived as being horizontal.

The sound collecting apparatus 10 (similarly to sound collecting apparatuses 20 and 30 to be described below) is installed at a position corresponding to an average height of a person (or a position corresponding to a height of the mouth of a standing person) such that a plane of the equator 12 is horizontal. However, the case of installing the sound collecting apparatus such that the plane of the equator 12 is horizontal is an example, and the sound collecting apparatus may be installed such that the plane of the equator 12 is not horizontal.

Base

The base 11 is a spherical shape. However, the "spherical body" used in the description and claims does not have to be a perfect sphere. For example, the "spherical body" also includes a shape in which a recess, a groove, or a shield is formed in the spherical body. Further, the outer shape of the "spherical body" does not need to be strictly spherical. For example, the "spherical body" also includes a shape where the strict sphere is distorted within a certain threshold range. In addition, the "spherical body" also includes a shape that is almost spherical when viewed from a person. Such a "spherical body" may be referred to as an "almost spherical body" or a "substantially spherical body".

A material of the base 11 is also not particularly limited, and the base 11 can be made of, for example, wood, plastic, metal, or a combination thereof. In addition, the inside of the base 11 may be filled with contents of the sphere, may have a structure of a spherical shell having a wall thickness of a certain depth from the surface of the sphere, or may have another structure.

Further, the size of the base 11 is also not particularly limited, and can have a diameter of 80 mm, for example. By setting the diameter to about 80 mm, the sound collecting apparatus can be conveniently carried around and can have a high resolution in a horizontal direction. Also, when the base is combined with a 360-degree camera commonly used, the diameter of about 80 mm allows the size to be fallen within a dead angle of the camera.

The matters regarding the base 11 described above are also applicable to bases 21 and 31 described below.

Arrangement of Microphones

As described above, the microphones (11-1 to 11-4) are provided in the base 11. Specifically, the microphones may be provided in a structure in which the microphones are attached to the surface of the spherical body forming the base 11; in a structure in which a recess is provided from the surface of the spherical body forming the base 11 to the inside and the microphones may be set on a bottom of the recess; or in any other structure. Details of the structure in which the recess is provided will be described below.

Note that in the first embodiment, since the depth of the recess is shallower than the diameter of the spherical body even in the case of the structure in which the microphones are set on the bottom of the recess, the following arrangement description of the microphones can be applied to both of the structure in which the microphones are attached to the surface of the spherical body and the structure in which the microphones are set on the bottom of the recess.

In the sound collecting apparatus 10 shown in FIG. 1, the spherical body forming the base 11 is equally divided into four semicircles 11*a* to 11*d* connecting the north pole and the south pole, and a microphone is installed on each of the semicircles (on a line thereof) one by one. Dividing into four equal parts is an example. More generally, a spherical body having M (M≥2) semicircles is equally divided into M parts, and a microphone is installed at any point on a line of each of the semicircles. The "equal division" does not need to be strictly equally divided. A division deviating from the equal division within a certain threshold may also be referred to as "equal division".

Figure 2:
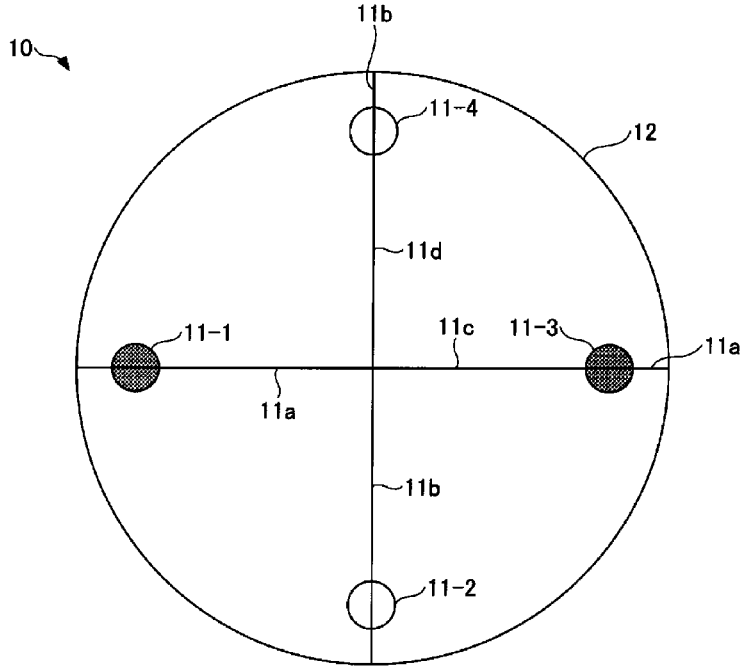
FIG. 2 is a top view of the sound collecting apparatus 10.

FIG. 2 is a top view of the sound collecting apparatus 10 as viewed from above, which shows a state of being equally divided into the four semicircles 11*a* to 11*d*.

In the sound collecting apparatus 10 shown in FIG. 1, the microphones are alternately installed on an equatorial plane which is a plane including the equator 12. In other words, the microphone 11-1 is installed below the equatorial plane, the microphone 11-2 adjacent thereto is installed above the equatorial plane, the microphone 11-3 adjacent thereto is installed below the equatorial plane, and the microphone 11-4 adjacent thereto is installed above the equatorial plane. In this way, the microphones are alternately installed above and below the equatorial plane as a reference. The microphones may be arranged not to contact with the plane of the equator 12. Further, both recesses to be described below and the microphones may be arranged not to contact with the plane of the equator 12.

In the sound collecting apparatus 10, distances of the microphones 11-1 to 11-4 from the equatorial plane are equal to each other. However, it is not essential that the distances are equal, and each of the microphones 11-1 to 11-4 may be installed at an arbitrary distance from the equatorial plane. Note that the meaning of "equal" does not need to be strictly equal, and for example, the meaning of "equal" also includes a difference within a certain threshold.

Figure 3:
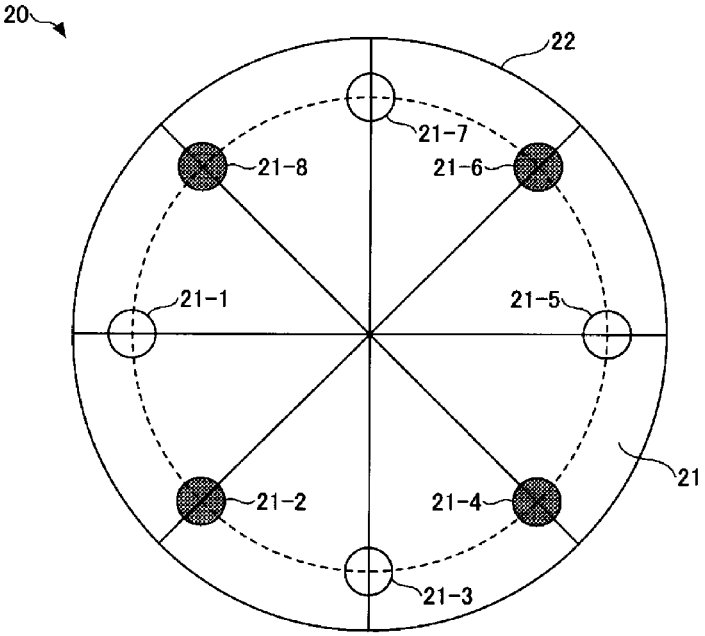
FIG. 3 is a top view of a sound collecting apparatus 20.

FIG. 3 is a plan view of a sound collecting apparatus 20 in which eight microphones are installed on a spherical base 21 as viewed from above. In the sound collecting apparatus 20, a spherical body is equally divided into eight semicircles, and a microphone is installed on a line of each of the semicircles. In addition, microphones are alternately installed on an equatorial plane which is a horizontal plane including an equator 22, and distances of microphones 21-1 to 21-8 from the equatorial plane are equal to each other.

Further, a distance between microphones adjacent to each other is equal on each of an upper side and a lower side of the equatorial plane. In other words, on the upper side of the equatorial plane, a distance between the microphone 21-1 and the microphone 21-3, a distance between the microphone 21-3 and the microphone 21-5, a distance between the microphone 21-5 and the microphone 21-7, and a distance between the microphone 21-7 and the microphone 21-1 are equal. On the lower side of the equatorial plane, a distance between the microphone 21-2 and the microphone 21-4, a distance between the microphone 21-4 and the microphone 21-6, a distance between the microphone 21-6 and the microphone 21-8, and a distance between the microphone 21-8 and the microphone 21-2 are equal. Further, for example, when the horizontal plane is viewed from above, the distance between the microphones adjacent to each other is also equal so that the distance between the microphone 21-1 and the microphone 21-2 and the distance between the microphone 21-2 and the microphone 21-3 are equal.

Figure 4:
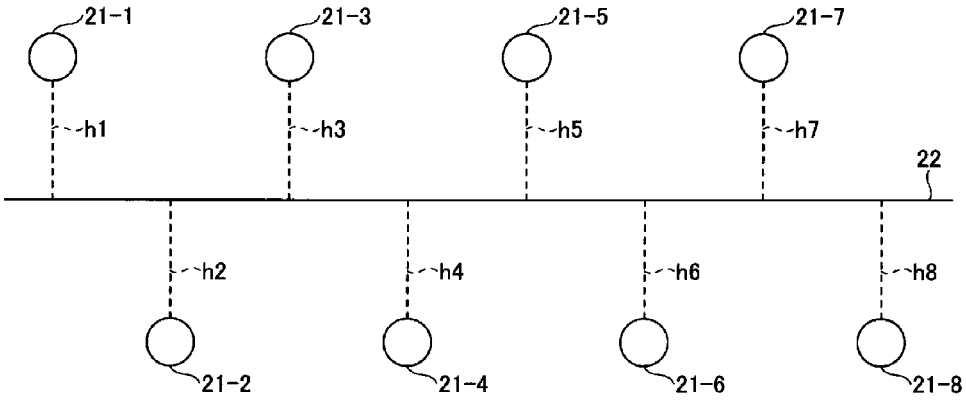
FIG. 4 is a view for illustrating arrangement of microphones in the sound collecting apparatus 20.

FIG. 4 shows an appearance of microphones in which a cylinder that is formed by moving a circle connecting the microphones 21-1 to 21-8 in FIG. 3 vertically relative to the equatorial plane is rolled out as a plane. As shown in FIG. 4, it is understood that the microphones are alternately installed on the equatorial plane 22 and distances (h1 to h8) from the equatorial plane are equal.

Note that the number of microphones installed above the equatorial plane may not be equal to the number of microphones installed below the equatorial plane.

Example of Detailed Structure

Figure 5:
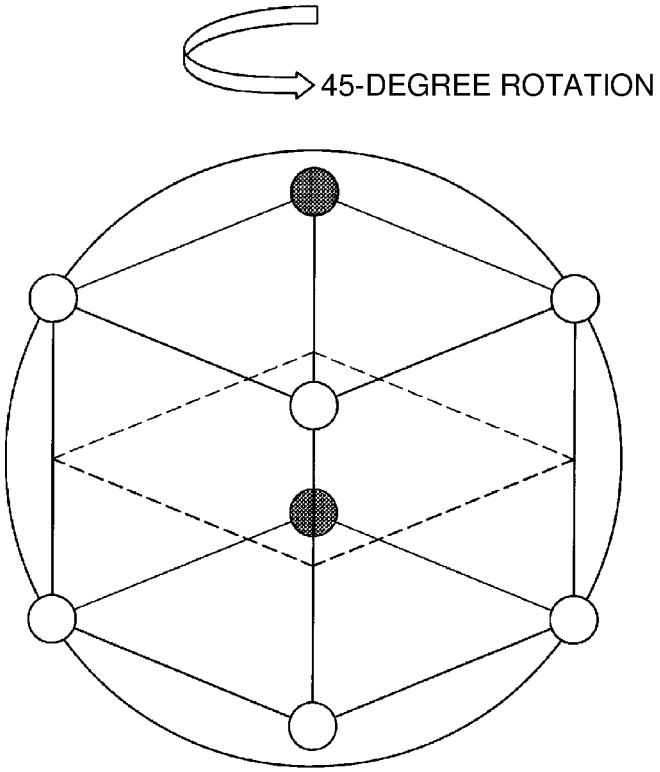
FIG. 5 is a view for illustrating a concept of the arrangement of the microphones in the sound collecting apparatus 20.
Figure 6:
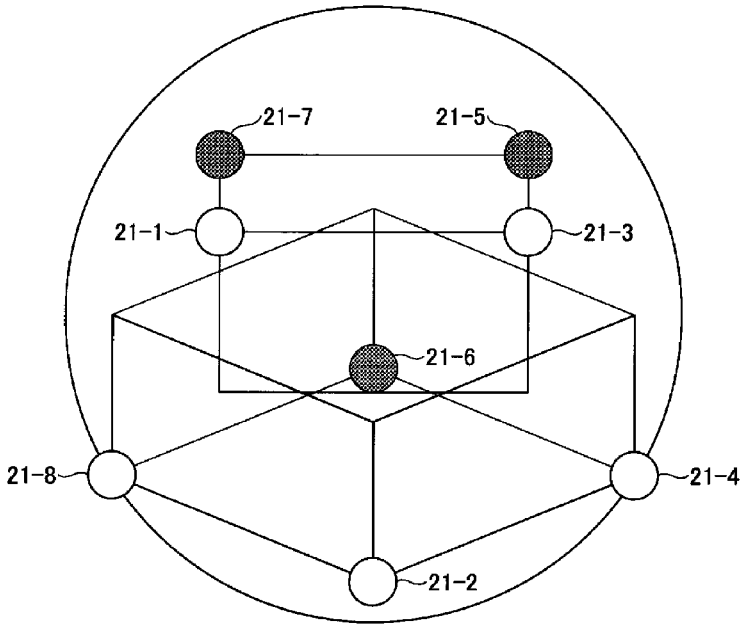
FIG. 6 is a view for illustrating a concept of the arrangement of the microphones in the sound collecting apparatus 20.

FIGS. 5 and 6 are diagrams for explaining a specific example of an arrangement method of the eight microphones in the sound collecting apparatus 20.

As shown in FIG. 5, a regular hexahedron (cube) inscribed in the spherical body forming the base 21 is considered, and the regular hexahedron is divided into two parts at the spherical equatorial plane (a broken line in FIG. 5). Then, an upper rectangular parallelepiped or a lower rectangular parallelepiped which is one of two divided parts is rotated by 45 degrees about a line connecting the north pole and the south pole.

FIG. 6 shows an arrangement of vertices after the upper rectangular parallelepiped is rotated by 45 degrees, and the microphones 21-1 to 21-8 are installed at these eight vertices to form the sound collecting apparatus 20.

By the arrangement method of the microphones described with reference to FIGS. 5 and 6, the alternate arrangement of the microphones described above and the property of equidistant arrangement of the microphones from the equatorial plane are realized.

Further, as shown in FIG. 6 in contrast to FIG. 5, the rectangular parallelepiped, which is a half of the cube, is shifted by 45 degrees, and thus it is possible to reduce the distance between the microphones in the horizontal direction without increasing the number of microphones and to improve the resolution in the horizontal direction without increasing costs. Further, since the microphones are installed on the spherical body, it is also possible to maintain performance to collect sound in all directions.

Figure 7:
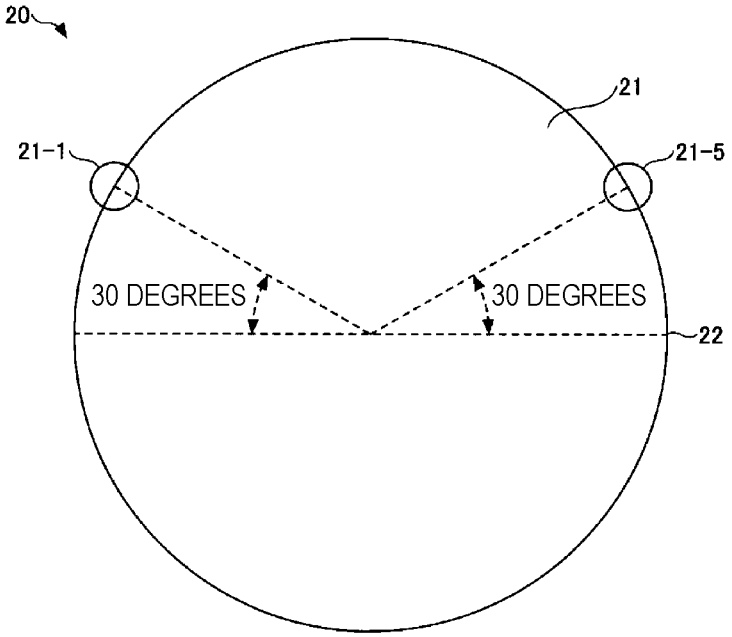
FIG. 7 is a view showing a position of the microphone in the sound collecting apparatus 20.

FIG. 7 is a view showing a cross section of the spherical body forming the base 21 taken along a plane including the north pole, the south pole, and the microphones 21-1 and 21-5. Note that the cross section does not show an internal structure of the base 21, but is used to explain positions of the microphones 21-1 and 21-5.

As shown in FIG. 7, an angle between a line connecting a center and the microphone 21-1 or 21-5 and the equatorial plane (the angle being referred to as an elevation angle) is 30 degrees. An angle between the line connecting the center and the microphone installed below the equatorial plane (the angle being referred to as a depression angle) is also 30 degrees.

As described above, when it is assumed that the sound collecting apparatus 20 is installed at a position corresponding to the average height of a person (or a position corresponding to the height of the mouth of a standing person) such that the equatorial plane is horizontal, there is an advantage that voices of most of people can be collected excellently, apart from those who are extremely tall or short by setting the elevation angle and the depression angle to about 30 degrees, respectively.

Note that it is not essential to set the elevation angle/depression angle to 30 degrees. For example, when the elevation angle is defined as A and thresholds are defined as S1 and S2 which are positive numbers determined in advance, a relation of (30−S1) degrees≤A degrees≤(30+S2) degrees may be satisfied. The thresholds S1 and S2 may be equal to each other, or may be different from each other. In addition, when the depression angle is defined as B and thresholds are defined as T1 and T2 which are positive numbers determined in advance, a relation of (30−T1) degrees≤B degrees≤(30+T2) degrees may be satisfied. The thresholds T1 and T2 may be equal to each other, or may be different from each other. In addition, the angles A and B may be equal to each other, or may be different from each other.

When only the resolution based on the horizontal plane is maximized without increasing the number of microphones, the microphones may be arranged on the horizontal plane such that the microphones are spaced equidistantly. However, since the heights of persons are different from person to person, the resolution is relatively reduced in voices emitted from a height different from the horizontal plane in the arrangement described above.

To cope with such diversity, in the present embodiment, the microphones are arranged such that the microphones are spaced substantially equidistantly when the horizontal plane is viewed from above and evenly arranged vertically relative to the horizontal plane. In this way, in addition to the resolution in the horizontal plane, an object to secure higher resolution as much as, although not exactly, that in the horizontal plane from the height according to the distribution of the person's height is achieved compared to the resolution in the direction in which person's voices are not normally expected to arrive.

Example with Support Member

The sound collecting apparatus 20 may include a support member 23 in order to hold the sound collecting apparatus 20 at a height approximately equal to the average height of the person, for example. For example, the support member 23 is a rod-shaped member, and is fixed to the base 21 in a state of passing through the north pole and the south pole of the base 21.

Figure 8:
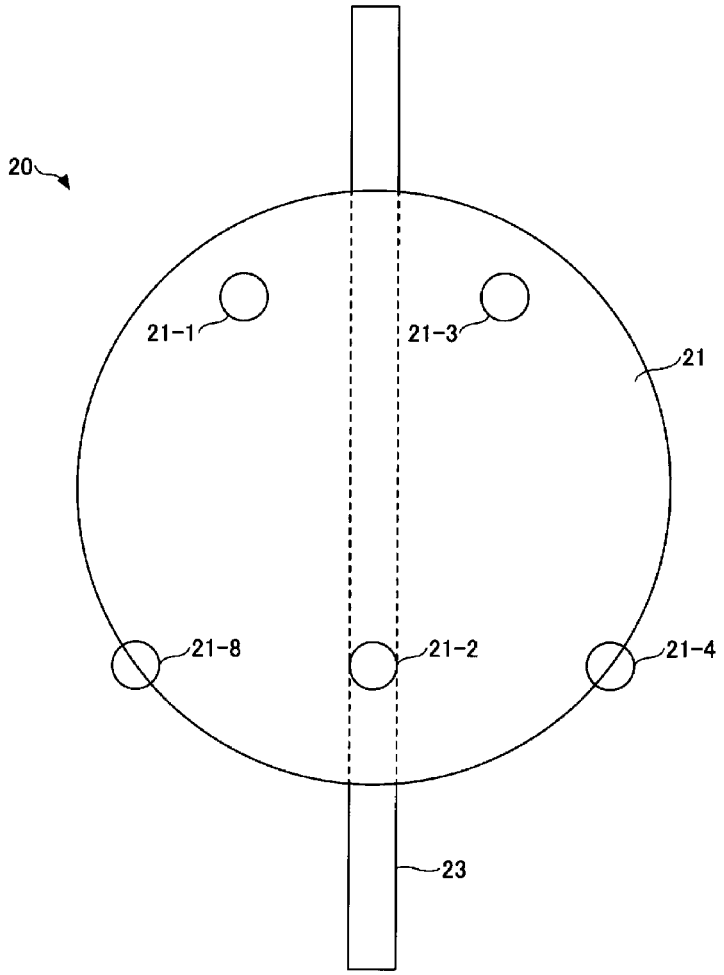
FIG. 8 is a front view of the sound collecting apparatus 20.
Figure 9:
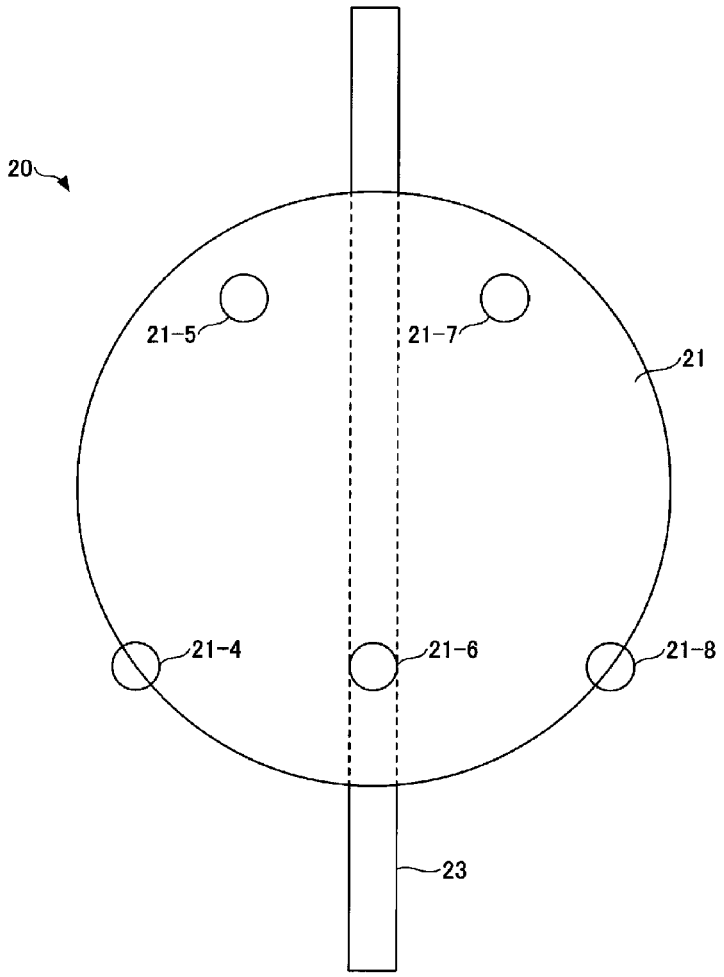
FIG. 9 is a rear view of the sound collecting apparatus 20.
Figure 10:
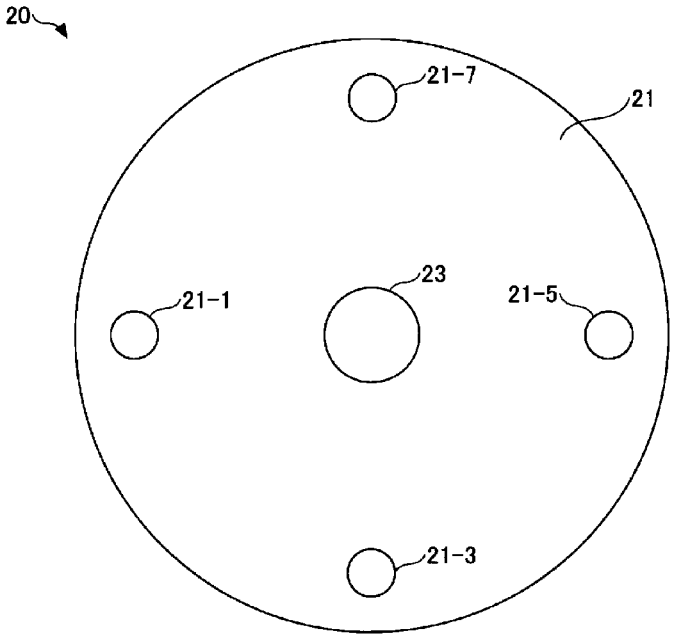
FIG. 10 is a top view of the sound collecting apparatus 20.
Figure 11:
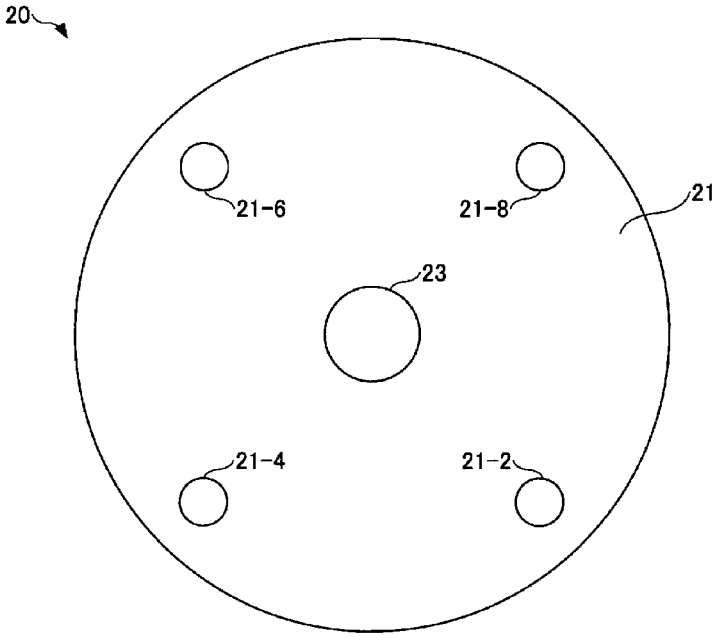
FIG. 11 is a bottom view of the sound collecting apparatus 20.

FIG. 8 is a front view of the sound collecting apparatus 20 including the support member 23 (a view as seen from a direction parallel to the equatorial plane). FIG. 9 is a rear view of the sound collecting apparatus 20 as viewed from a side opposite to the front (FIG. 8). FIG. 10 is a top view of the sound collecting apparatus 20 as viewed from above. FIG. 11 is a bottom view of the sound collecting apparatus 20 as viewed from below.

As shown in FIGS. 8 to 11, the support member 23 penetrated the base 21. The sound collecting apparatus 20 may be held in a state where a lower side of the support member 23 is set to an appropriate length and a lower end of the support member 23 is arranged on the ground, or the sound collecting apparatus 20 may be held in a state where a person holds the support member 23 with a hand.

As shown in FIGS. 8 to 11, since the rod-shaped support member 23 is provided in the state of penetrating through the north pole and the south pole of the base 21, it is possible to hold the sound collecting apparatus 20 with a minimum influence on the sound collection.

Figure 12:
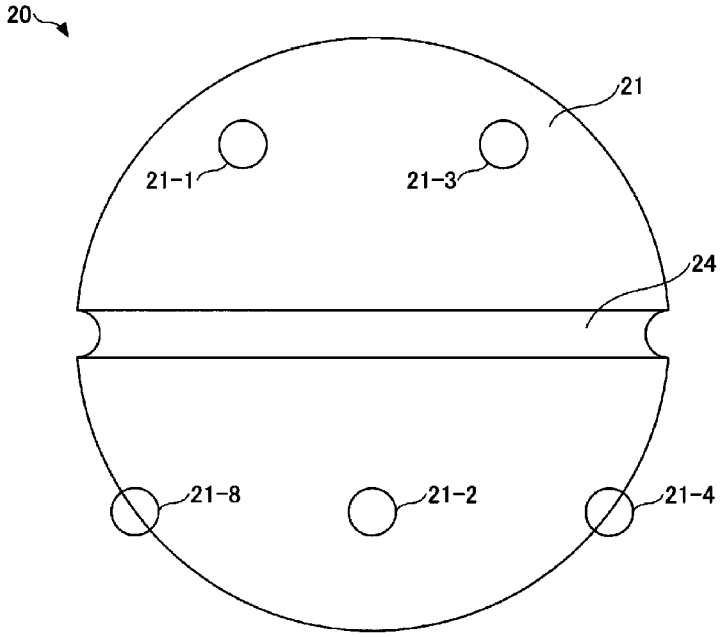
FIG. 12 is a view showing a structure in which a groove is provided in the sound collecting apparatus 20.

FIG. 12 is a view showing another structure example regarding the holding, and is a front view of the sound collecting apparatus 20. In the example of FIG. 12, the sound collecting apparatus 20 includes a groove 24 on the equator of the base 21. The groove has a width that does not interfere with any microphone. The groove is fitted with a member such that the sound collecting apparatus 20 is sandwiched and held.

Example of Recess

As described above, in the sound collecting apparatus 20, each of the microphones can be provided at the bottom of a recess provided on the surface of the base 21, for example.

Figure 13:
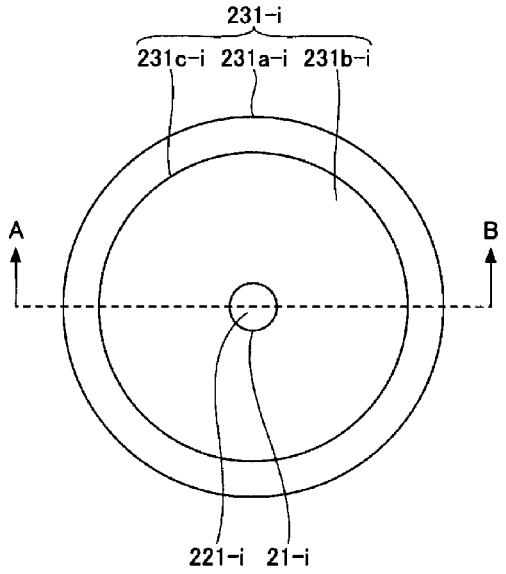
FIG. 13 is a view showing an example of a shape of a recess in which microphones are installed.
Figure 13:
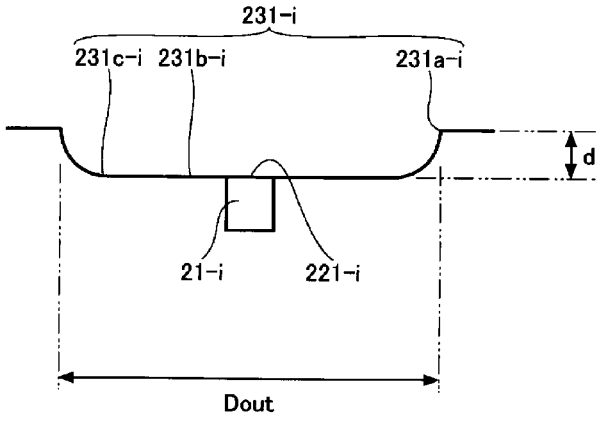

FIG. 13 is a view showing an example of a shape of a recess in which each of the microphones is provided. The recess is provided for each of the microphones, and FIG. 13 shows a recess 231-*i* (where, i=1, . . . , N, here N=8) of an i-th microphone. The recesses 231-*i* (i=1, . . . , N) have the same shape. However, some recesses of i=1, . . . , N may be different from other recesses.

FIG. 13(*a*) is a top view of the recess 231-*i* as viewed from above, and FIG. 13(*b*) is a cross-sectional view taken along a line A-B in FIG. 13(*a*). As illustrated in FIGS. 13(*a*) and 13(*b*), the recess 231-*i* is a recess having a dish-shaped inner wall surface. In other words, an edge portion 231*a*-*i* on an open end side (a front surface side) of the recess 231-*i* has a circular shape, and an inner bottom surface 231*b*-*i* (a bottom surface inside the recess 231-*i*) of the shape recess 231-*i* is a circular flat surface (an edge portion 231*c*-*i* of the inner bottom surface 231*b*-*i* being a circular flat surface). However, the "circular shape" used herein does not need to be strictly circular, and includes a shape similar to a circle. Further, the "plane" herein does not need to be strictly planar, and includes a shape similar to a plane.

A diameter Din of the edge portion 231*c*-*i* of the inner bottom surface 231*b*-*i* is smaller than or equal to a diameter Dout of the edge portion 231*a*-*i* on the open end side of the recess 231-*i*, for example, the diameter Din is smaller than the diameter Dout. A region between the edge portion 231*a*-*i* and the edge portion 231*c*-*i* corresponds to an inner wall surface of the recess 231-*i*.

In the examples of FIGS. 13(*a*) and 13(*b*), the diameter Din is smaller than the diameter Dout, and the inner wall surface between the edge portion 231*a*-*i* and the edge portion 231*c*-*i* is formed in a slope shape and is smoothly connected to the inner bottom surface 231*b*-*i*. The depth d of the recess 231-*i* is not particularly limited, but is smaller than half the diameter Dout of the edge portion 231*a*-*i* on the open end side of the recess 231-*i*, for example.

The diameters Dout and Din are larger than a diameter of a sound collection unit 221-*i* of the microphone 21-*i*. The sound collection unit 221-*i* is a unit including a mechanism (for example, a diaphragm or a metal foil) configured to convert air vibration of sound into an electric signal. The sound collection unit 221-*i* is provided on one end side of the microphone 21-*i*, for example. When the diameter of the base 21 is set to be about 80 mm, the depth d is 2 mm as an example. However, the depth of 2 mm is merely an example.

Second Embodiment

A sound collecting apparatus 30 according to a second embodiment will be described below. In the sound collecting apparatus 30 according to the second embodiment, a recess deeper than the recess described in the first embodiment is provided, so that difference in transfer characteristics of sounds collected by respective microphones is increased and thus the sound resolution is improved. The second embodiment is substantially the same as the first embodiment except for the shape of the recess.

In addition, the sound collecting apparatus 30 of the second embodiment may have a shape (Pattern 1) in which the recess (shield) of the first embodiment is deepened. Further, the sound collecting apparatus 30 of the second embodiment may have a shape (Pattern 2) in which the spherical body forming the base 21 of the first embodiment is reduced in size such that a radius thereof is a distance from the center to the sound collection unit of the microphone (a distance in the sound collecting apparatus 30) and in which a shield corresponding to the recess is provided at a position of the microphone of the spherical body that is reduced in size. The spherical body provided with the shield has a size similar to the size (diameter of about 80 mm) of the base 21 of the first embodiment. In the following description, the shield will be referred to as a recess in both cases of Pattern 1 and Pattern 2.

In the sound collecting apparatus 30 according to the second embodiment, eight microphones are installed on the spherical body by the same arrangement method as in the sound collecting apparatus 20 (FIG. 6). More specifically, recesses are provided at eight vertices shown in FIG. 6, respectively, and the microphones are provided at the bottoms of the recesses. Considering Pattern 2 described above, the eight microphones are arranged on the surface of the spherical body as shown in FIG. 6. As described above, setting the number of microphones to eight is merely an example. Further, all the recesses may have the same shape, or some recesses may have different shape from the other recesses.

Figure 14:
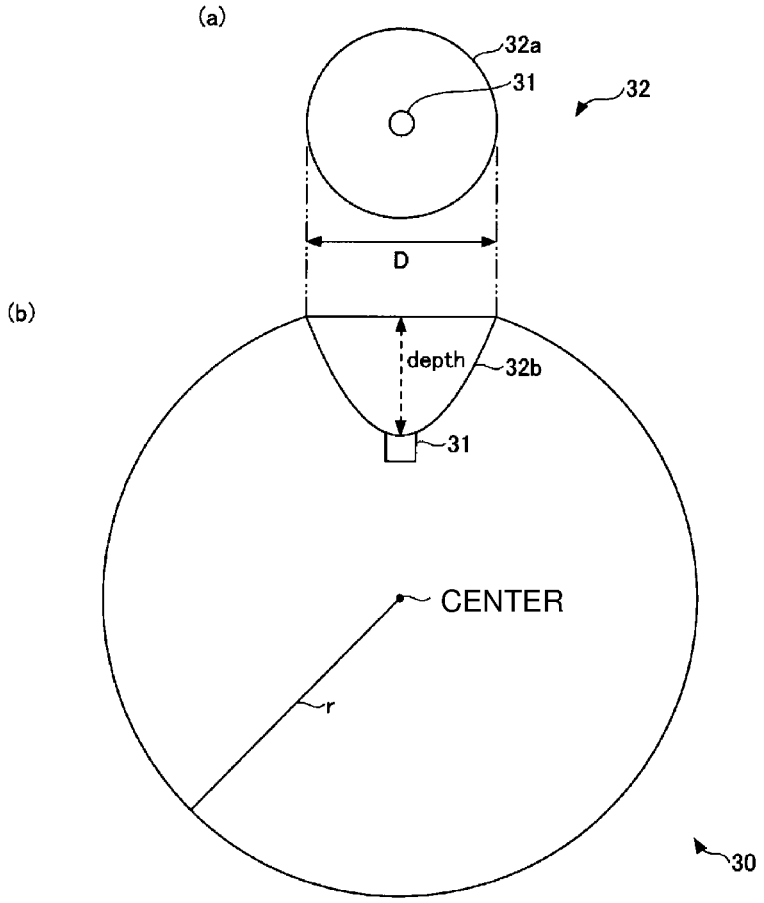
FIG. 14 is a view showing an example of a shape of a recess in a sound collecting apparatus 30.

FIG. 14 is a view focusing on one recess 32 of the eight recesses provided in the base (spherical body) of the sound collecting apparatus 30.

Figure 15:
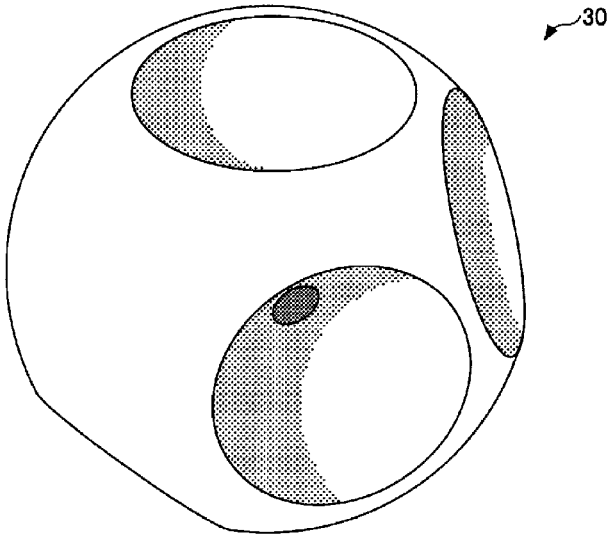
FIG. 15 is a perspective view of the sound collecting apparatus 30.

FIG. 14(*a*) is a top view of the recess 32 as viewed from above. As shown in FIG. 14(*a*), the recess 32 has a shape of a circle 32*a*, and a microphone 31 is provided at the center of the circle. FIG. 14(*b*) is a cross-sectional view of the recess 32 obtained by cutting the base along the plane including the center of the circle 32*a* of the recess 32 and the center of the base. FIG. 15 is a perspective view of the sound collecting apparatus 30 according to the second embodiment.

In FIG. 14, "depth" as a distance (a depth) between the plane including the circle 32*a*, which is an edge portion of the recess 32, and an upper surface of the microphone 31 (that is, a bottom of the recess 32) is larger than the depth (d) of the recess described in the first embodiment.

Upon determining a diameter D and the depth "depth" of the circle 32*a*, first, these are determined so that the recesses do not interfere with each other. For example, when the diameter D is too large, adjacent recesses may overlap with each other, and thus a desired shape may not be formed. At this time, the adjacent recesses should not interfere with each other. Further, for example, the depth "depth" is set to be smaller than a radius "r" of the spherical body. The plurality of recesses provided in the sound collecting apparatus 30 may have substantially the same shape and size, or the plurality of recesses provided in the sound collecting apparatus 30 may have different shapes and sizes within a predetermined range.

The shape of the recess 32 is, for example, a shape obtained by rotating a curved line 32*b* around a straight line connecting the center of the circle 32*a* and the center of the base. However, the shape of the recess 32 is not limited to the shape of the rotating body.

For example, assuming that the circle 32*a* is located on an xy plane with the center of the circle 32*a* as the origin and a distance of each point on the surface (curved surface) of the recess 32 from the plane is defined as z, the shape (curved shape) of the recess 32 can be expressed as z=f(x, y) using a certain function f. The f(x, y) is approximately represented by a polynomial expression having the diameter D of the circle 32*a* and the depth "depth" of the recess 32 as parameters, for example. These parameters are used, for example, as coefficients in one or more terms in the polynomial expression.

The shape of the recess 32 described above is merely an example. For example, the shape of the recess on the surface of the base (surface of the spherical body) of the sound collecting apparatus 30 may be a point-symmetrical shape with respect to a point where a normal line from the center of the base to the surface of the base intersects the surface. In addition, for example, the shape of the recess taken along a plane including the normal line may be a line-symmetrical shape with respect to the normal line, and the shape may be approximately represented by a polynomial expression. Further, the polynomial expression may be a polynomial expression having a size of the shape of the recess on the surface of the base and a depth of the recess as parameters.

Specific contents of the polynomial expression described above are determined by a simulation for evaluating the resolution of sound using the sound collecting apparatus 30 formed with various polynomial expressions, for example.

Effects

Directivity was evaluated by a simulation of sound output from a sound source using the sound collecting apparatus 20 or the sound collecting apparatus 30 described above. For comparison, the sound collecting apparatus of the cubic vertex arrangement (FIG. 5) and the sound collecting apparatus of the equator vertex arrangement were also used.

Figure 16:
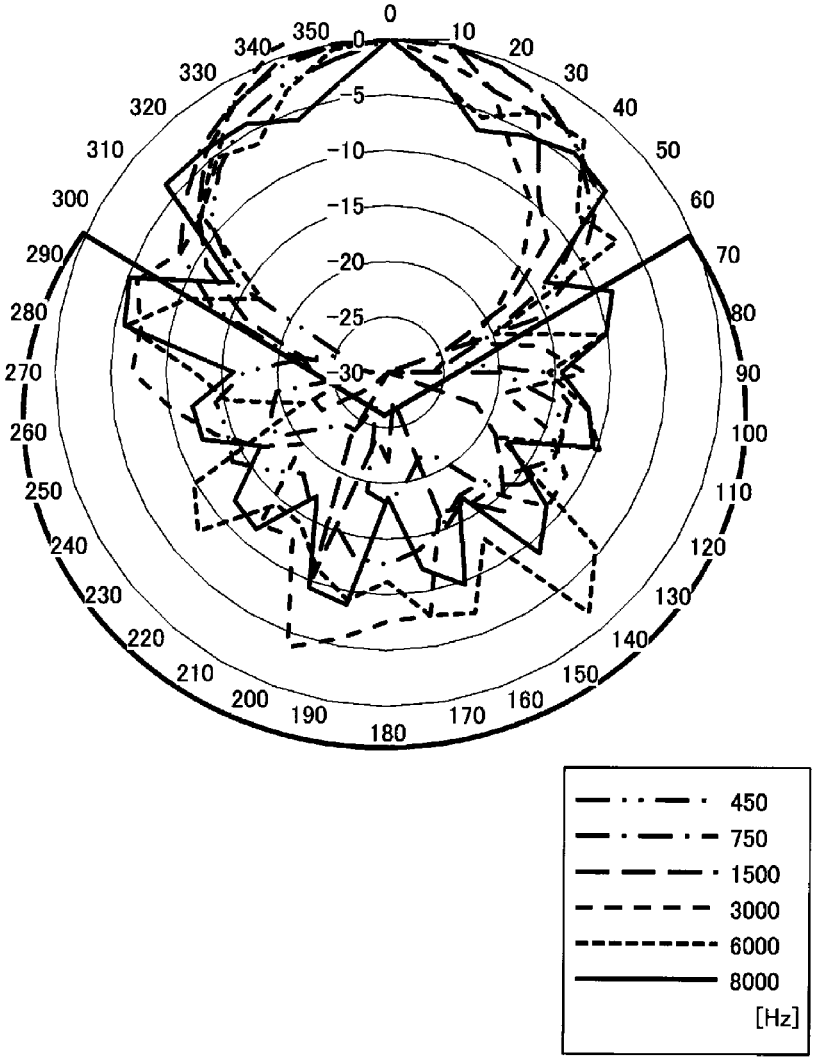
FIG. 16 is a view showing an evaluation result of directivity of cube vertex arrangement.
Figure 17:
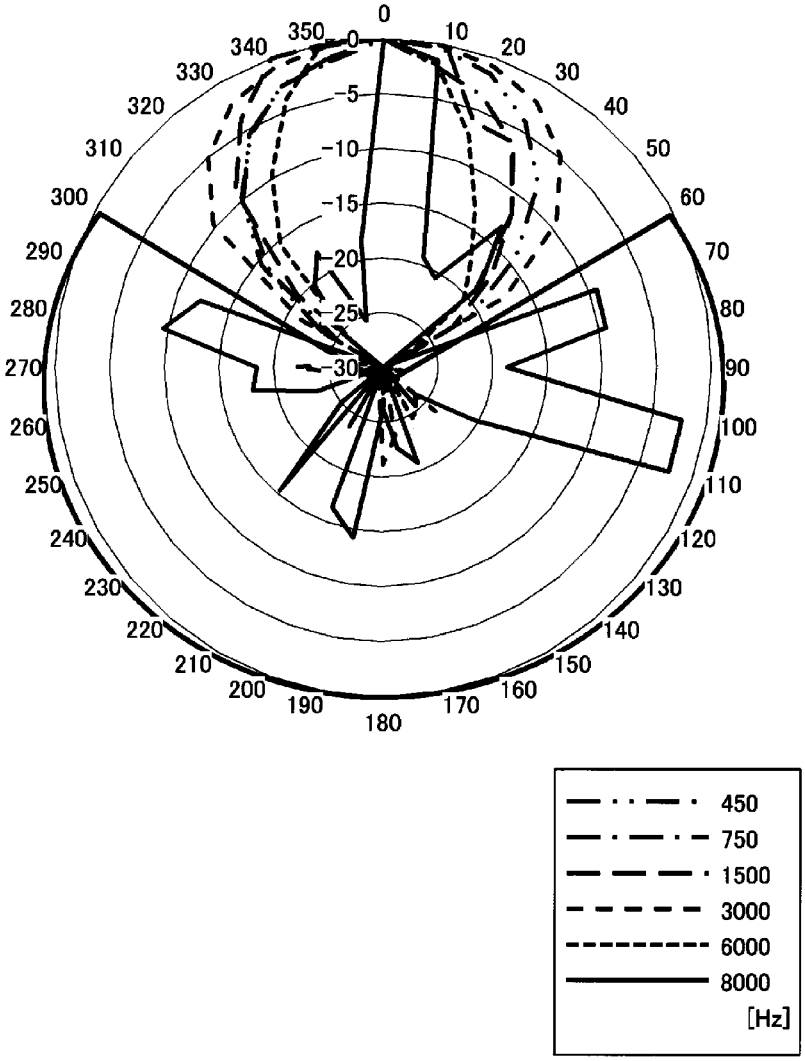
FIG. 17 is a view showing an evaluation result of directivity of the sound collecting apparatus 20.

FIG. 16 shows the directivity of the sound collecting apparatus (FIG. 5) of the cubic cube vertex arrangement, and FIG. 17 shows the directivity of the sound collecting apparatus 20 (FIG. 6) described in the first embodiment. The directivity shown in FIGS. 16, 17, 18, and 19 are obtained by plotting the sensitivity of the microphone for each frequency band in respective directions on the horizontal plane, and a target direction corresponds to 0 degrees in the drawings.

As shown in FIGS. 16 and 17, it can be seen that the sound collecting apparatus 20 can effectively reduce the sensitivity in directions other than the target direction, compared with the sound collecting apparatus of the cubic vertex arrangement. Further, by adopting the microphone arrangement as shown in FIG. 6, the distance between the microphones can be made small in external appearance, and thereby, an excellent directivity can be realized in a wider band.

Figure 18:
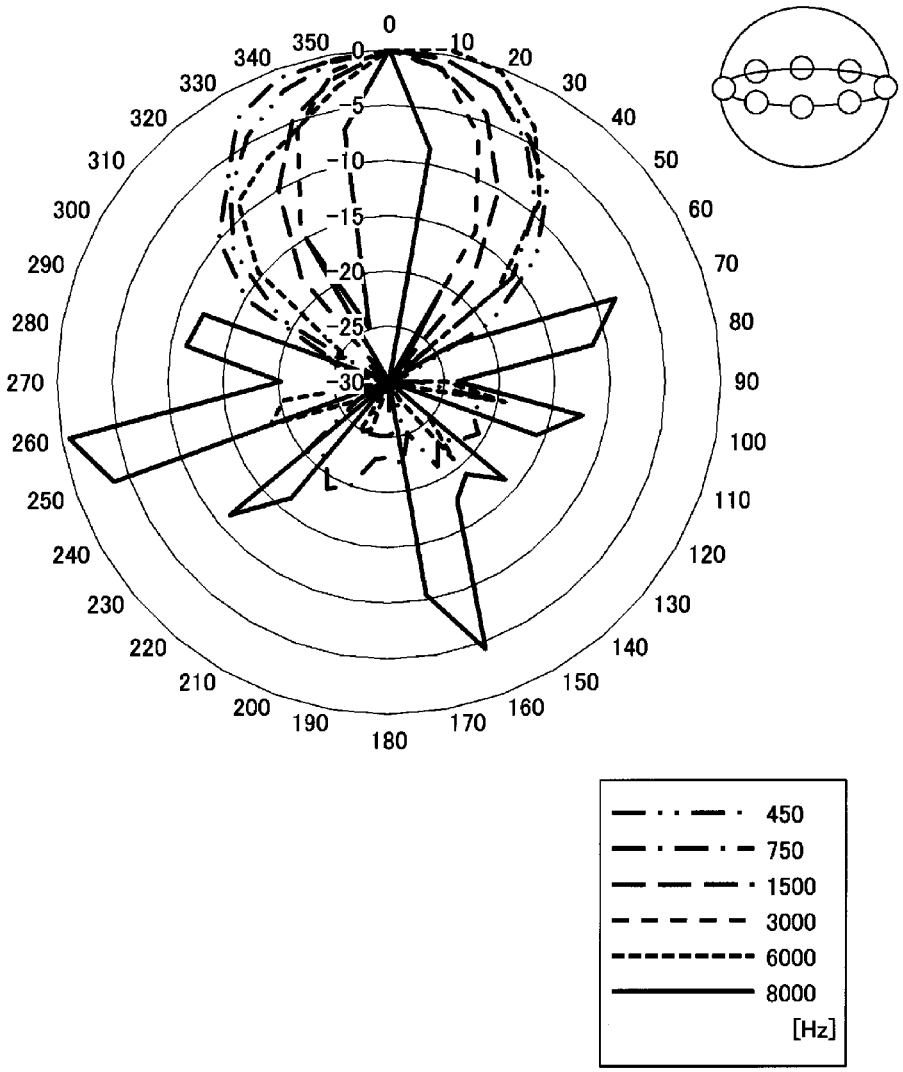
FIG. 18 is a view showing an evaluation result of directivity of equator arrangement.

FIG. 18 shows directivity of the sound collecting apparatus in which the microphones are arranged only on the equator part. As can be seen by comparing FIG. 17 and FIG. 18, it can be confirmed that the sound collecting apparatus 20 according to the first embodiment can obtain the directivity in the horizontal direction equivalent to that of the sound collecting apparatus of the equator arrangement.

Figure 19:
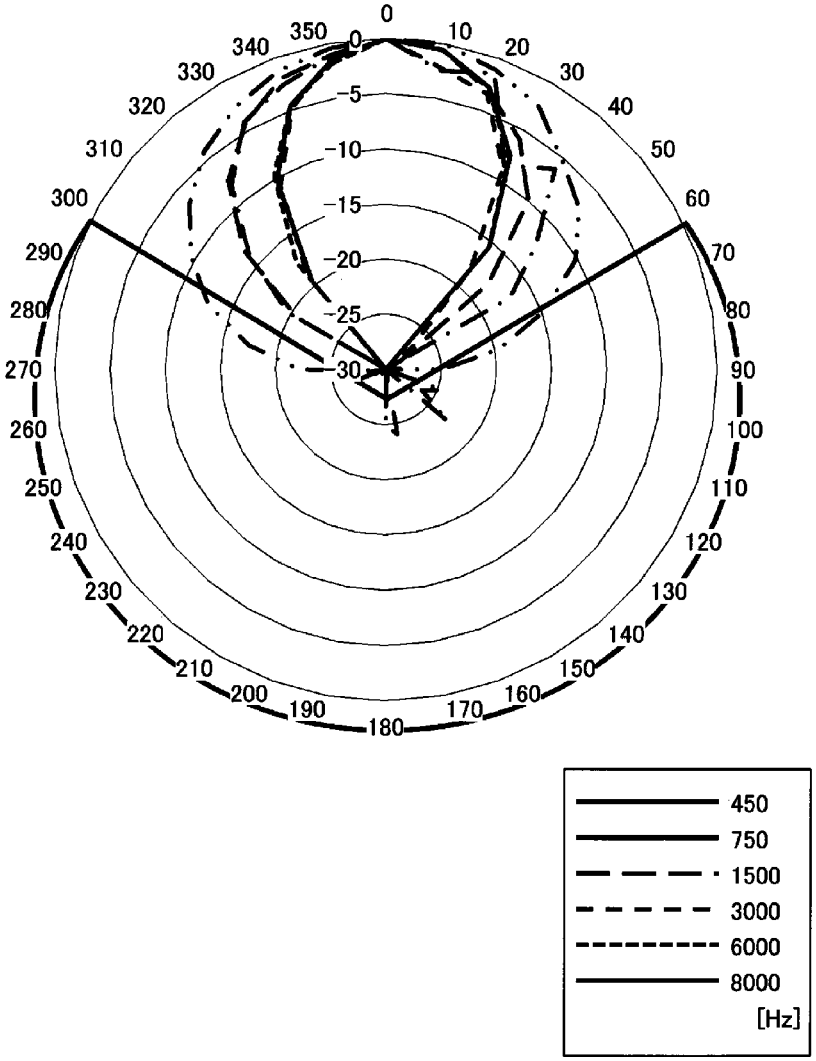
FIG. 19 is a view showing an evaluation result of directivity in a horizontal direction of the sound collecting apparatus 30.

FIG. 19 shows the directivity of the sound collecting apparatus 30 according to the second embodiment. As can be seen by comparing FIG. 19 and FIG. 17, compared with the directivity of the sound collecting apparatus 20 in which only the microphone arrangement is taken into consideration (FIG. 17), in the sound collecting apparatus 30 in which the microphone arrangement and the shape of the recess are taken into consideration, directivity deterioration at 8 kHz can be improved, and stable directivity can be realized in all target frequency bands.

In other words, it is possible to realize the sound collecting apparatus that can collect sounds from all directions without increasing the number of microphones and can collect sounds in the horizontal direction with higher resolution.

The sound collecting apparatuses described in the embodiments can be used for, for example, sound collection in which the direction of directivity is changed in all 360 degrees in real time on a signal processing side without moving the main body of the sound collecting apparatus. Further, when recording is performed with the sound collecting apparatus, it is possible to extract sounds in a direction toward a point desired to be heard, at the time of editing. More specifically, the sound collecting apparatuses described in the embodiments can be used in live coverage of sports games or live recording, without missing sounds in the recording, home videotaping that can be corrected to sounds as desired to be heard later, and 360-degree content production combined with an omnidirectional camera.

Summary of Embodiments

At least the following clauses are disclosed in the description above.

Clause 1

A sound collecting apparatus including:

a base of a substantially spherical body; and a plurality of microphones provided on the base, a number of the microphones having a predetermined constraint, the plurality of microphones being alternately arranged vertically relative to a horizontal plane including a center of the substantially spherical body in order to improve resolution in a horizontal direction.

Clause 2

The sound collecting apparatus according to Clause 1, wherein the microphones are arranged on a plane including a midpoint of a straight line and being vertical to the straight line, the straight line connecting two microphones adjacent to each other in one space of two spaces divided by the horizontal plane, the microphones being arranged in another space of the two spaces.

Clause 3

The sound collecting apparatus according to Clause 1 or 2, wherein all of the plurality of microphones have a same distance from the horizontal plane.

Clause 4

The sound collecting apparatus according to any one of Clauses 1 to 3, wherein the base is provided with a groove including an outer peripheral portion of a circle formed as an intersection of the horizontal plane and the substantially spherical body.

Clause 5

The sound collecting apparatus according to any one of Clauses 1 to 4, wherein the base is provided with a shield structure for each of the microphones for increasing difference in transfer characteristics between a sound source and each of the microphones among the microphones.

Clause 6

The sound collecting apparatus according to Clause 5, wherein the shield structure is a recess formed from a surface to an inside of the base, and the microphone is provided at a bottom of the recess.

Clause 7

The sound collecting apparatus according to Clause 6, wherein a shape of the recess on the surface of the base is a point-symmetrical shape with respect to a point where a normal line from the center to the surface of the base intersects with the surface, and a shape of the recess taken along a plane including the normal line is a line-symmetrical shape, and the shape is approximately represented by a polynomial expression.

Although the present embodiments have been described above, the present invention is not limited to such particular embodiments, and various modifications and changes can be made within the scope of the gist of the present invention described in the claims.

REFERENCE SIGNS LIST

10, 20, 30 Sound collecting apparatus
11, 21 Base
12 Equator
23 Support member
24 Groove
31 Microphone
32 Recess

The invention claimed is:

1. A sound collecting apparatus with improved resolution of collecting sound from a source in a horizontal direction, comprising:

a base of a substantially spherical body; and a plurality of microphones provided on the base, a number of the microphones having a predetermined constraint, the plurality of microphones being alternately arranged vertically within a predetermined elevation angle between a horizontal plane including a center of the substantially spherical body and a line connecting from the center of the substantially spherical body to a microphone in the plurality of microphones thereby collecting sound in a higher resolution from a horizontal direction than other directions.

2. The sound collecting apparatus according to claim 1, wherein the microphones are arranged on a plane including a midpoint of a straight line and being vertical to the straight line, the straight line connecting two microphones adjacent to each other in one space of two spaces divided by the horizontal plane, the microphones being arranged in another space of the two spaces.

3. The sound collecting apparatus according to claim 1, wherein all of the plurality of microphones have a same distance from the horizontal plane.

4. The sound collecting apparatus according to claim 1, wherein the base is provided with a groove including an outer peripheral portion of a circle formed as an intersection of the horizontal plane and the substantially spherical body.

5. The sound collecting apparatus according to claim 1, wherein the base is provided with a shield structure for each of the microphones for increasing difference in transfer characteristics between a sound source and each of the microphones among the microphones.

6. The sound collecting apparatus according to claim 5, wherein the shield structure is a recess formed from a surface to an inside of the base, and the microphone is provided at a bottom of the recess.

7. The sound collecting apparatus according to claim 6, wherein a shape of the recess on the surface of the base is a point-symmetrical shape with respect to a point where a normal line from the center to the surface of the base intersects with the surface, and a shape of the recess taken along a plane including the normal line is a line-symmetrical shape, and the shape is approximately represented by a polynomial expression.

8. The sound collecting apparatus according to claim 1, wherein the plurality of microphones being alternately arranged vertically at least within a predetermined depression angle between relative to the horizontal plane including a center of the substantially spherical body and the line connecting from the center of the substantially spherical body to the microphone in the plurality of microphones in order to thereby collecting sound in the higher resolution from the horizontal direction than other directions.

9. The sound collecting apparatus according to claim 1, wherein the base is vertically positioned at substantially in proximity to an average height of people targeted for collecting voices.

10. The sound collecting apparatus according to claim 1, wherein the base is vertically positioned at substantially in proximity to a predetermined height of a person targeted for collecting voices.

11. The sound collecting apparatus according to claim 1, the apparatus further comprising:

a support member for holding the sound collecting apparatus, the support member includes a rod-shape section fixed to the base, and the support member is configured to pass through the north pole and the south pole of the base.

12. A method for collecting sound with improved resolution of collecting sound from a source in a horizontal direction, comprising:

collecting sound in a higher resolution from a horizontal direction than other directions by plurality of microphones, the plurality of microphones being provided on a base including a substantially spherical body, a number of the microphones having a predetermined constraint, the plurality of microphones being alternately arranged vertically within a predetermined elevation angle between a horizontal plane including a center of the substantially spherical body and a line connecting from the center of the substantially spherical body to a microphone in the plurality of microphones, and the sound being in a higher resolution from a horizontal direction than other directions.

13. The method according to claim 12, wherein the microphones are arranged on a plane including a midpoint of a straight line and being vertical to the straight line, the straight line connecting two microphones adjacent to each other in one space of two spaces divided by the horizontal plane, the microphones being arranged in another space of the two spaces.

14. The method according to claim 12, wherein two or more of the plurality of microphones have a same distance from the horizontal plane.

15. The method according to claim 12, wherein the base is provided with a groove including an outer peripheral portion of a circle formed as an intersection of the horizontal plane and the substantially spherical body.

16. The method according to claim 12, wherein the base is provided with a shield structure for each of the microphones for increasing difference in transfer characteristics between a sound source and each of the microphones among the microphones.

17. The method according to claim 16, wherein the shield structure is a recess formed from a surface to an inside of the base, and the microphone is provided at a bottom of the recess.

18. The method according to claim 17, wherein a shape of the recess on the surface of the base is a point-symmetrical shape with respect to a point where a normal line from the center to the surface of the base intersects with the surface, and a shape of the recess taken along a plane including the normal line is a line-symmetrical shape, and the shape is approximately represented by a polynomial expression.

19. The method according to claim 12, wherein the plurality of microphones being alternately arranged vertically at least within a predetermined depression angle between relative to the horizontal plane including a center of the substantially spherical body and the line connecting from the center of the substantially spherical body to the microphone in the plurality of microphones in order to thereby collecting sound in the higher resolution from the horizontal direction than other directions.

20. The method according to claim 12, wherein the base is vertically positioned at substantially in proximity to an average height of people targeted for collecting voices.

21. The method according to claim 12, wherein the base is vertically positioned at substantially in proximity to a predetermined height of a person targeted for collecting voices.

22. The method according to claim 12, wherein the base attaches to a support member for holding the base, the support member includes a rod-shape section, and the support member is configured to pass through the north pole and the south pole of the base.

* * * * *